United States Patent [19]

Dola

[11] 4,394,548

[45] Jul. 19, 1983

[54] JOYSTICK SWITCH

[75] Inventor: Frank P. Dola, Port Richey, Fla.

[73] Assignee: AMP Incorporated, Harrisburg, Pa.

[21] Appl. No.: 355,818

[22] Filed: Mar. 8, 1982

[51] Int. Cl.[3] ..... H01H 25/00; H01H 3/02

[52] U.S. Cl. ..... 200/6 A; 200/5 R; 200/17 R; 200/153 K

[58] Field of Search ..... 200/5 R, 5 A, 6 A, 17 R, 200/16 C, 16 D, 153 K

[56] References Cited

U.S. PATENT DOCUMENTS

| | | | |
|---|---|---|---|
| 2,686,233 | 8/1954 | Obszarny | 200/6 A |
| 2,857,485 | 10/1958 | Brooks | 200/6 A |
| 2,863,010 | 12/1958 | Riedl | 200/6 A X |
| 3,005,055 | 10/1961 | Mattke | 200/6 A X |
| 4,029,915 | 6/1977 | Ojima | 200/6 A X |
| 4,124,787 | 11/1978 | Aamoth | 200/6 A |
| 4,172,972 | 10/1979 | Sykora et al. | 200/16 D X |
| 4,297,542 | 10/1981 | Shumway | 200/5 R X |
| 4,319,099 | 3/1982 | Asher | 200/5 A |

OTHER PUBLICATIONS

IBM Tech. Disc. Bull., W. A. Bennett, Jr. et al., "Digital Joystick Switch", vol. 21, No. 11, May 1979, pp. 4962–4964.

*Primary Examiner*—J. R. Scott

*Attorney, Agent, or Firm*—F. Brice Faller

[57] ABSTRACT

Joystick switch comprises a handle attached to a contact carrying support member which is latchably carried by latch arms attached to a contact carrying base member. Contacts are cast in loop-like patterns toward the periphery of each member and an elastomeric member inside the bounds of the contacts between the support member and base provides resilient return action. A plunger carried in a bore in the handle and through the elastomeric member closes contacts in the base and is operated independently of the joystick directional control.

15 Claims, 7 Drawing Figures

45
44
42
43
41
37
29
33
38
34
28
35
39
25
24
26
27
22
21
18
19
17
16
14
10
12
50
49
48
56
57
54
52
51
53

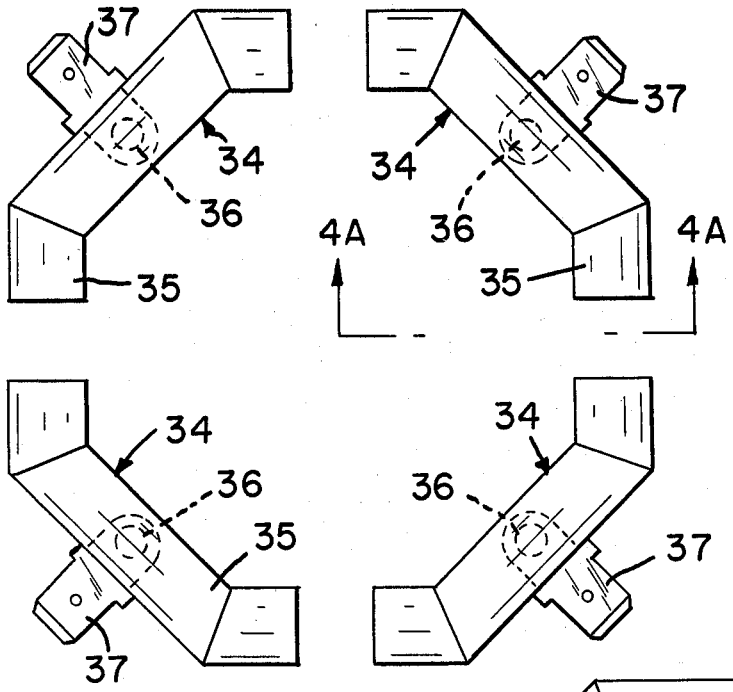
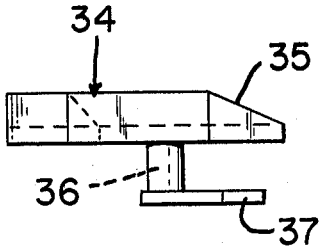
Fig. 4A
Fig. 4
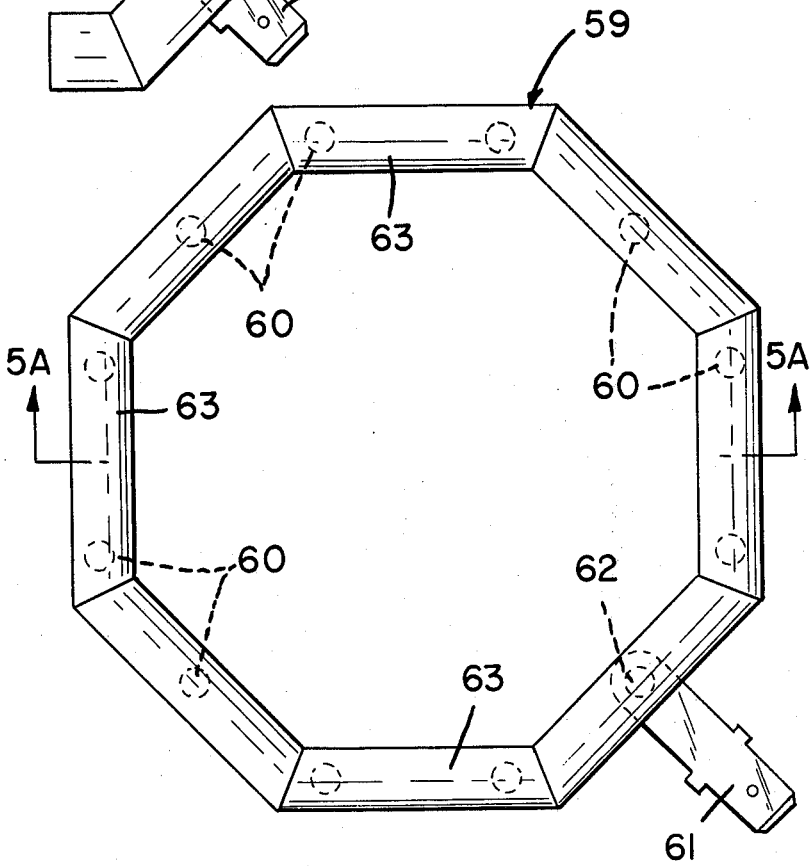
Fig. 5
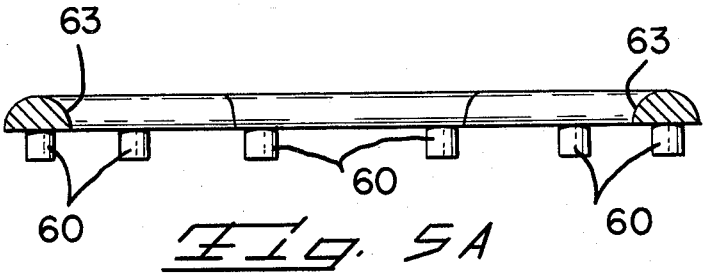
Fig. 5A

JOYSTICK SWITCH

BACKGROUND OF THE INVENTION

The present invention relates to a joystick switch, a device for generating signals for x-y directional control responsive to pivotal movement of an elongate handle.

Joystick switches are currently enjoying popularity as x-y directional control switches in electronic games found both in commercial environments and in the home in conjunction with television sets. Joystick switches of the prior art generally employ ball and socket type joints and individual switches which are actuated by one end of the joystick in response to movement of the handle end of the stick by the operator's hand. Cam tracks are often employed to direct the end of the joystick to the desired switch and metal springs are often employed to effect return of the handle. Known joystick assembly schemes are often complex in structure and time-consuming and expensive to manufacture.

SUMMARY OF THE INVENTION

The present invention is directed to a joystick switch which is inexpensive to manufacture, employs a minimum of parts, and is simple to assemble. The joystick employs a support member with an elongate handle which is pivoted about latches carried by a base to close die cast contacts carried by the support member and the base. Return action is provided by an elastomeric member in the form of a foam rubber cylinder sandwiched between the base and the support member and inside the boundary of the contacts. A "firing button" may be optionally provided at the end of the elongate handle by simple modification of the basic structure. The simplicity of design makes the subject joystick switch quite durable and resistant to breakage.

BRIEF DESCRIPTION OF THE DRAWINGS

FIG. 4 is a plan view of the first contact means.

FIG. 4A is a section view taken along line 4A-4A of FIG. 4.

FIG. 5 is a plan view of the second contact means.

FIG. 5A is a section view taken along line 5A-5A of FIG. 5.

DETAILED DESCRIPTION OF THE PREFERRED EMBODIMENT

Figure 1:
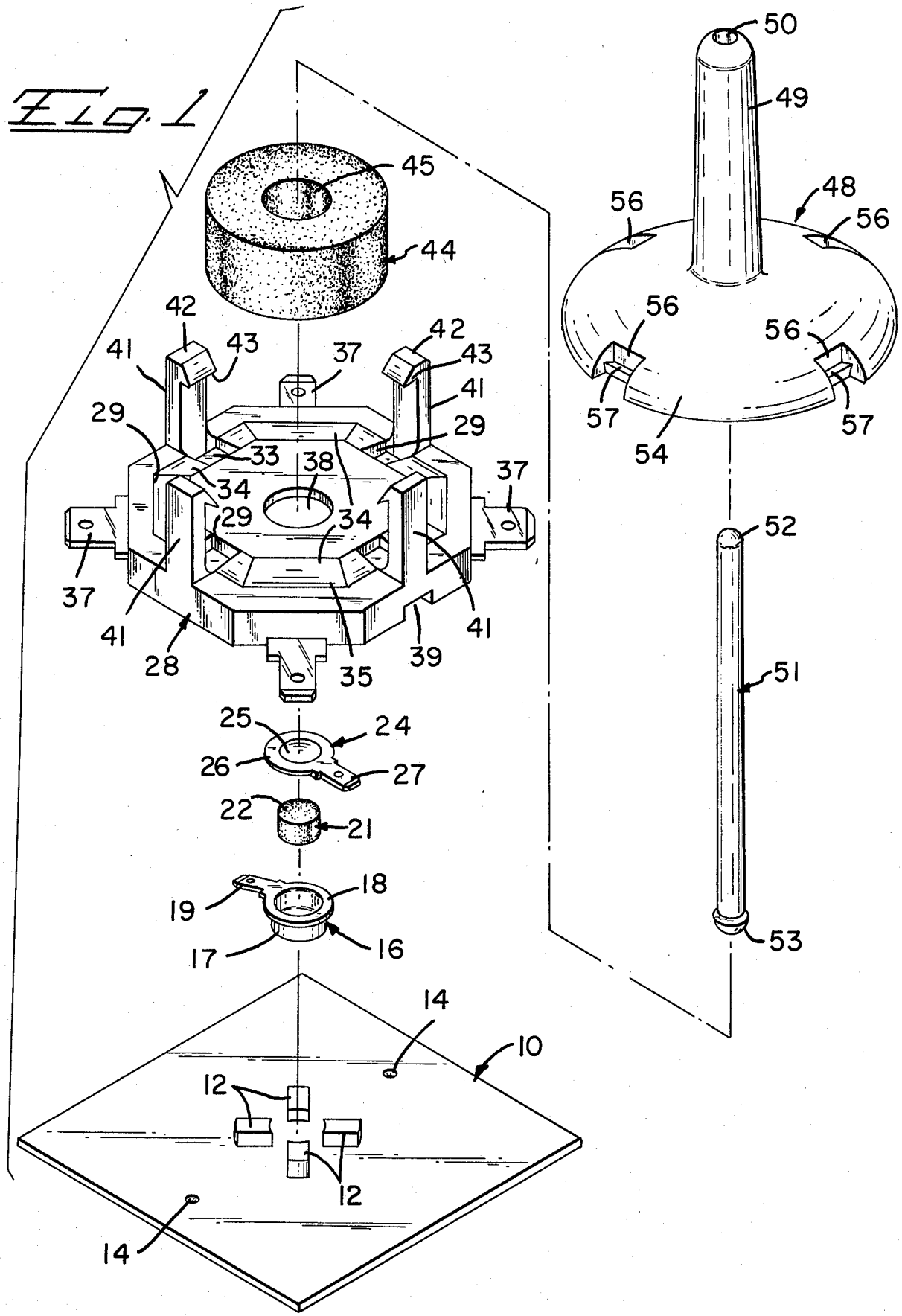
FIG. 1 is an exploded perspective of the joystick switch.

FIG. 1 is an exploded perspective of the joystick switch of the present invention depicting the components thereof prior to assembly, which consist of a substrate 10, a stamped and formed metal cup member 16, an elastomeric button 21, a stamped and formed metal cap member 24, a base 28, an elastomeric member 44, a plunger 51, and a support member 48. The substrate 10 has four positioning members 12 which are spaced to receive cylindrical section 17 of cup member or fourth contact means 16 therebetween. The cup member 16 has an annular brim 18 about the top of cylindrical section 17 and an electrical contact tab 19 extending therefrom. A sponge button or second elastomeric member 21 is profiled to fit in cylindrical section 17 and has a concave arcuate top surface 22 which extends above brim 18. The surface 22 is profiled to fit snugly against the convex side of arcuate concave surface 25 of cap member or third contact means 24, which has an annular brim 26 and an electrical contact tab 27 extending therefrom.

Base member 28 is preferably nylon and has an octagonal channel 29 therein which has first contact means in the form of four discrete contacts 34 set therein. The contacts are preferably zinc and are placed by die casting the metal directly into the channel 29. The casting dies are profiled to bear against platforms 33 in the channel 29 to separate the contacts 24 during casting. Each contact 34 has an electrical contact tab 37 integral therewith as will be shown in detail in conjunction with FIG. 4A. Four equally spaced latch arms 41 are situated adjacent respective platforms 33 and extend normally from the base 28 about the periphery thereof. Each latch arm 41 has a distal end 42 and a latch 43 thereon facing hole 38 through the center of base 28. A first elastomeric member 44 is cylindrical in shape with a concentric hole 45 therethrough and is profiled to sit on the base 28 within the boundary defined by the channel 29 so that hole 45 is aligned with hole 38 in the base 28.

Cap or support member 48, also of moulded nylon, has a disc portion 54 and an elongate handle 49 extending from said disc portion 54. The handle 49 has a linear axial hole or bore 50 extending through the length thereof and through said disc portion 54. The bore 50 is profiled to closely receive rod-like elongate plunger 51 having a first end 52 and a second end or ball end 53. The disc portion 54 has four equally spaced insets or recesses 56 about the periphery thereof, each inset 56 having a ledge 57 thereon which is mateable with a respective latch 43 on respective latch arms 41.

Figure 2:
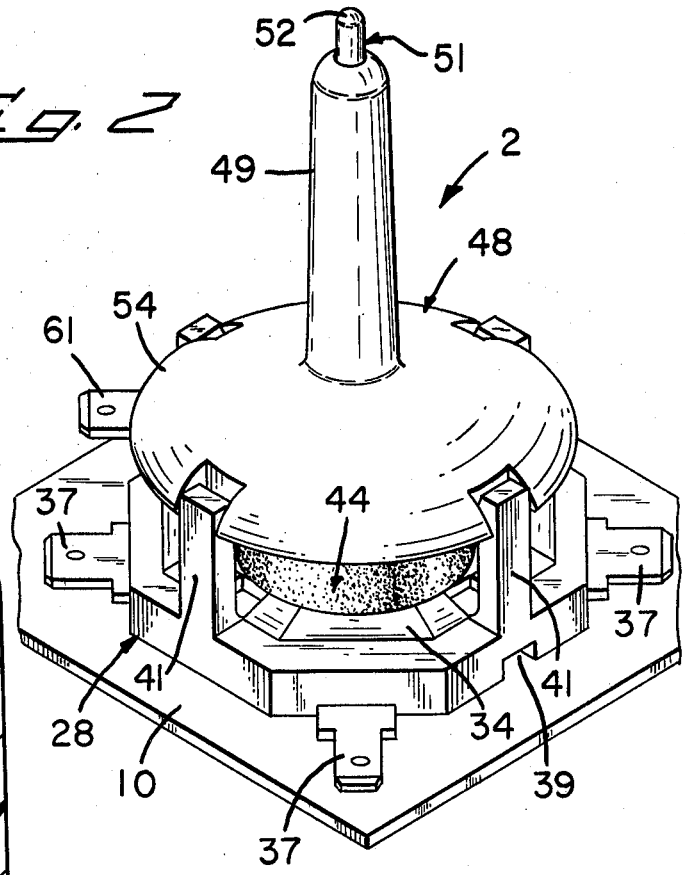
FIG. 2 is a perspective of the assembled switch.

Referring still to FIG. 1, the joystick is assembled by placing the cup member between support members 12 on the substrate 10, placing the button 21 in the cylindrical portion 17 and placing cap member 24 thereon. Wires (not shown) are connected to tabs 19, 27 and the base 28 is then fixed to substrate 10 using screws through holes 14 in the substrate or other suitable fixing means (not shown), such as resilient latches integral with the substrate 10 or latches integral with the underside of base 28 profiled to fit in holes through the substrate 10. The underside of base 28 is profiled with channels 39 to permit entry of wires attached to tabs 19, 27. After assembling the base 28 to substrate 10, the elstomeric member 44 is set on the base 28, the plunger 51 is fit into the bore 50 from the underside of cap 48, and the cap 48 is fit to the base 28 by flexing latch arms 41 away from each other and over respective ledges 57 in recesses 56. The assembled joystick switch 2 is showin in FIG. 2; x-y directional control signal wires are subsequently fixed to contact tabs 37, and a current input wire is fixed to contact tab 61.

Figure 3:
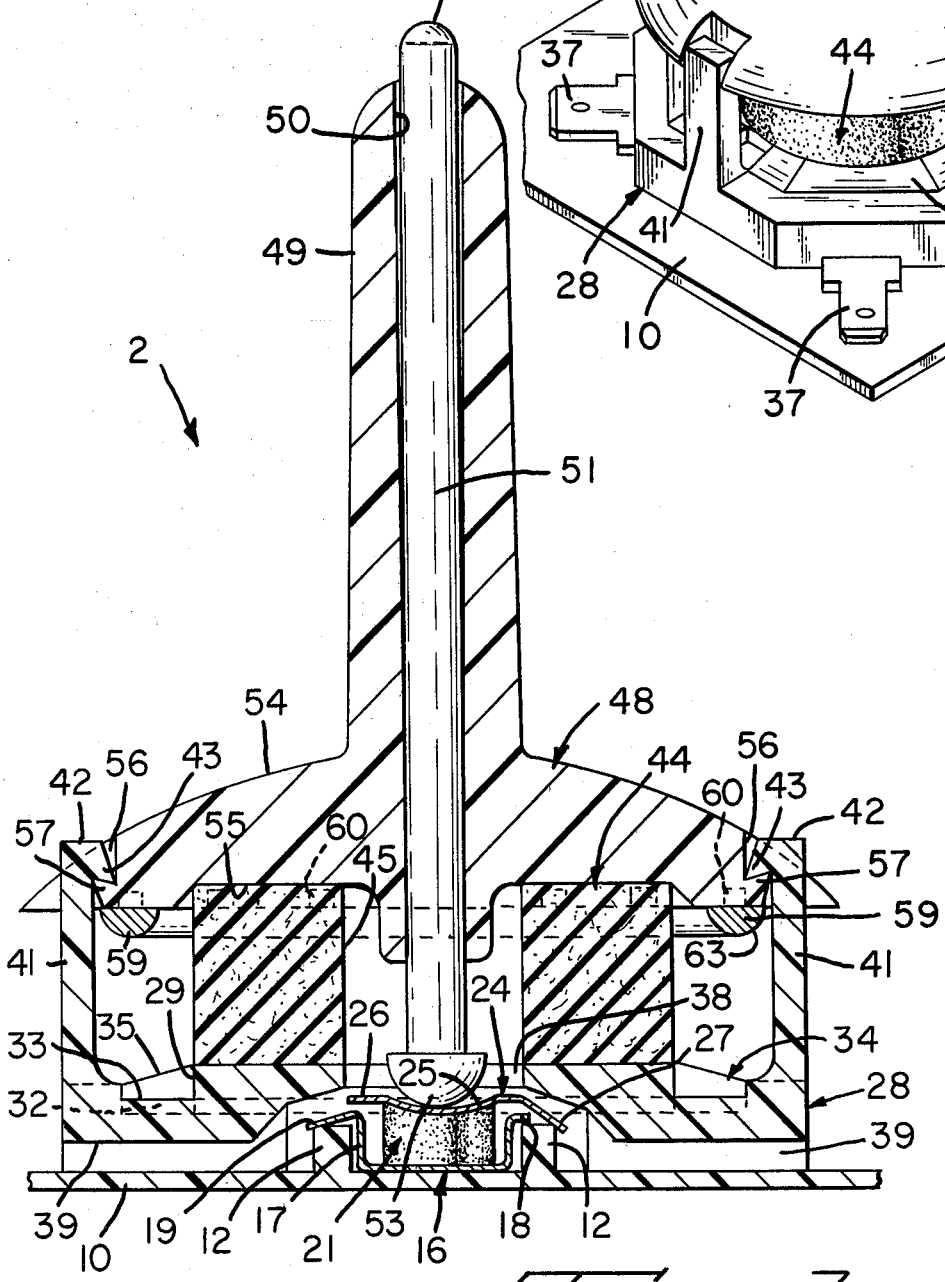
FIG. 3 is a cross section of the assembled switch.

FIG. 3 is a cross section of the assembled switch 2 where the operation thereof is most readily apparent. A circular contact 59 is fixed by means of posts 60 to the underside of disc portion 54 of support member 48 close to the periphery thereof and is also preferably of zinc die cast directly to member 48; an electrical contact 61 (FIG. 2) is integral with ring 59. The contacts 34 in base member 28 have planar with ring 59. The contacts 34 in base member 28 have planar surfaces 35 which are sloped downward toward the periphery of the base 34. The elastomeric member 44 bears resiliently against the base 28 and the annular surface 55 on the underside of cap 48 to maintain the ledges 57 against the latches 43.

Referring still to FIG. 3, x-y directional control signals are generated by lateral movement of handle 49, which causes the support member 48 to pivot about one of the latches 43 on the distal end 42 of one of the latch arms 41, compressing the elastomeric member 44 until the continuous loop or contact ring 59 bears against one of the contacts 35. Note that for handle movement in some directions, two latches 43 may act as pivot points simultaneously. Further, when the handle 49 is moved in a direction substantially opposite one of the latch arms 41, it is possible for the ring 59 to bridge two contacts 35 across one of the platforms 33, as the platforms 33 are recessed below canted surfaces 35. Thus, in the embodiment shown, eight different signal combinations are possible. Where only four signals are desired, as for movement strictly in x-y directions, platforms 33 would be raised above canted surfaces 35 to preclude the possibility of bridging two contacts 34 simultaneously.

FIG. 3 also depicts the operation of plunger 51 to best advantage. Pressure brought to bear against first end 52 causes second or ball end 53 to bear on concave surface 25 of contact 24, which causes brim 26 to contact brim 18 to close a circuit. This action is achieved most readily by gripping the handle 49 with a clenched hand and bearing on the firing button 52 with the thumb. When thumb pressure is removed, the resilient action of second elastomeric member 21 will break the circuit. Note that the plunger 52 may be operated regardless of the orientation of handle 59, and thus would be especially useful in an electronic game where, for example, the x-y directional control would be used for evasive or tactical maneuvers while the plunger 51 would be used as a "firing button" to discharge rockets or the like toward the enemy.

FIGS. 4 and 4A depict the frst contact means or contacts 34 in plan and section respectively. The canted surfaces 35, in combination with the octagonal shape, have been found to effect a sliding or wiping action when contacted by second contact means or loop 59 (FIGS. 5 and 5A). The posts 36 are cast through the base 28 and serve to anchor the contacts 34 thereto as well as a complete electrical circuit between the canted surfaces 35 and the contact tabs 37. FIGS. 5 and 5A depict the second contact means or continuous octagonal loop 59 in plan and section respectively. Studs 60 are cast into like profiled recesses in the cap or support member 48 (FIGS. 1, 2 and 3), and through post 62 provides positive anchoring in addition to completing an electrical circuit between rounded surface 63 and contact tab 61. The rounded surface 63 helps effect a good wiping action between contact 59 and contacts 34. Zinc is the preferred metal for these contacts as it is possible to die cast zinc into nylon by known processes, and further is somewhat soft to facilitate the wiping action.

The foregoing description is exemplary and not intended to limit the scope of the claims which follow.

I claim:

1. A joystick switch assembly which comprises:

an elongate handle;

a base member lying in a plane extending transversely of the axis of said handle, said base member having first contact means thereon;

a support member integral with said handle which supports said handle for arcuate movement, said support member moving relative to said base member, said support member having second contact means thereon arranged to contact said first contact means upon moving said handle in a predetermined direction;

a plurality of elongate latch arms integral with one of said members and extending between said base and said support member, said latch arms having distal ends with latches thereon which limit the relative movement of said support member away from said base member; said distal ends serving as pivot points for said arcuate movement of said support member; and first resilient means between said support member and said base member, said first resilient means urging said support member away from said base member.

2. A joystick switch as in claim 1 wherein said latch arms are integral with said base and extend substantially normal thereto, said distal ends being disposed about the periphery of said support member, said latches being cooperable with said support member to limit movement thereof away from said base member.

3. A joystick switch as in claim 2 wherein said support member has a like plurality of recesses in the periphery thereof, each said recess being positioned to receive the distal end of a respective latch arm.

4. A joystick switch as in claim 2 wherein said plurality of latch arms is four, said latch arms being disposed an equal distance apart, the distal ends thereof being spaced ninety degrees apart about the axis of said elongate handle.

5. A joystick switch as in claim 1 wherein said first contact means comprises four discrete contacts.

6. A joystick switch as in claim 5 wherein said discrete contacts are set in an octagonal channel in said base member, each contact occupying the full length of one leg and part of the length of two adjacent legs of said channel.

7. A joystick switch as in claim 6 wherein each contact has an exposed planar surface defined by a respective plane which is unique for each leg of the octagon, each contact thereby having three such planar surfaces, said planes all being only slightly canted from a common plane and converging at a common apex toward the center of said base.

8. A joystick switch as in claim 5 wherein said second contact means comprises a continuous loop of metal.

9. A joystick switch as in claim 1 wherein said first resilient means comprises a first elastomeric member axially disposed between said support member and said base, said first and second contact means being disposed about the periphery of said first elastomeric member.

10. A joystick switch as in claim 1 wherein said switch further comprises:

continuous linear bore means axially through said handle and said support member, said bore means carrying elongate plunger means therein, said plunger means having a first end extending beyond the distal end of said handle and a second end extending beyond said support member and toward said base; and switch means mounted on said base proximate said second end of said plunger means and actuable thereby.

11. A joystick switch as in claim 10 wherein said first resilient means comprises a first elastomeric member axially disposed between said support member and said base, said member having aperture means axially therethrough, said aperture means accommodating said plunger means.

12. A joystick switch as in claim 11 wherein said switch means comprises:

a third contact means in contact with said second end of said plunger means, said third contact means being movable relative to said base;

fourth contact means stationary relative to said base and arranged to be contacted by said third contact means when said plunger means is advanced through said bore means toward said base; and second resilient means urging said third contact means away from said second contact means.

13. A joystick switch as in claim 12 wherein, said third contact means is a substantially flat piece of stamped and formed metal having an arcuate concave surface facing said second end of said plunger means and an annular brim surrounding said concave surface;

said fourth contact means is a substantially cup-shaped piece of stamped and formed metal having a cylindrical section and an annular brim which faces said annular brim of said third contact means;

said second resilient means is a second elastomeric member disposed in said cylindrical section and bearing against a convex surface opposite said concave surface of said third contact means.

14. The joystick switch of claim 1 wherein said first contact means is composed of metal cast on said base member.

15. The joystick switch of claim 1 wherein said second contact means is composed of metal cast on said support member.

* * * * *